US006305881B1

(12) United States Patent
Schellstede

(10) Patent No.: US 6,305,881 B1
(45) Date of Patent: Oct. 23, 2001

(54) BARGE STABILIZATION METHOD

(75) Inventor: Herman J. Schellstede, New Iberia, LA (US)

(73) Assignee: Herman J. Schellstede & Associates, Inc., New Iberia, LA (US)

( * ) Notice: Subject to any disclaimer, the term of this patent is extended or adjusted under 35 U.S.C. 154(b) by 0 days.

(21) Appl. No.: 09/316,068

(22) Filed: May 21, 1999

Related U.S. Application Data

(60) Provisional application No. 60/086,618, filed on May 22, 1998.

(51) Int. Cl.[7] ..... E02B 17/08; E02D 23/08; E02D 27/12

(52) U.S. Cl. ..... 405/227; 405/8; 405/200; 405/205; 405/207; 114/265

(58) Field of Search ..... 405/203, 205, 405/207, 218, 224, 227, 195.1, 196, 200, 8, 303; 114/256, 264, 265, 270, 312

(56) References Cited

U.S. PATENT DOCUMENTS

| | | | | |
|---|---|---|---|---|
| Re. 30,823 | | 12/1981 | Guy et al. | 405/204 |
| 3,001,370 | * | 9/1961 | Templeton | 405/200 |
| 3,593,529 | * | 7/1971 | Smulders | 114/265 X |
| 3,605,669 | * | 9/1971 | Yu | 114/265 X |
| 3,859,806 | | 1/1975 | Guy et al. | 405/204 |
| 3,872,679 | * | 3/1975 | Fischer | 405/200 |
| 3,874,180 | | 4/1975 | Sumner | 405/198 |
| 4,069,680 | * | 1/1978 | Erler | 405/224 |
| 4,257,720 | | 3/1981 | Ostgaard | 405/227 |
| 4,417,664 | * | 11/1983 | Gordon | 405/200 X |
| 4,456,404 | * | 6/1984 | Evans | 405/196 |
| 4,575,282 | | 3/1986 | Pardue, Sr. et al. | 405/228 |
| 4,611,953 | * | 9/1986 | Owens | 405/224 |
| 4,907,912 | * | 3/1990 | Smith | 405/200 X |
| 4,973,200 | * | 11/1990 | Kaldenbach | 405/205 |
| 5,219,451 | * | 6/1993 | Datta et al. | 405/203 X |
| 5,241,572 | * | 8/1993 | Matthews | 405/196 X |
| 5,522,680 | * | 6/1996 | Hoss et al. | 405/195.1 X |
| 5,855,455 | * | 1/1999 | Williford et al. | 114/265 X |

* cited by examiner

*Primary Examiner*—David Bagnell
*Assistant Examiner*—Tara L. Mayo
(74) *Attorney, Agent, or Firm*—Jacobson Holman, PLLC

(57) ABSTRACT

An oil drilling barge stabilization system and method provide that an array of substantially vertically-oriented piles is formed in the sea bed to a depth beneath the sea bed that finds solid support. A barge is towed into position over the array of piles, and the barge is partially flooded with ballast to lower it in the water so that a set of cylindrical tubes is positioned to surround top ends of at least some of the piles. Air is then forced into the tubes to force the water out the bottom of the tubes, to create a dry environment for workers. Workers weld the tubes to the piles. The air pressure is removed from the interior of the tubes so that water may again flood the bottom of the tubes. The joints between the tubes and piles secure the barge to the array of piles, even in the face of varying tides, currents, and ice flow conditions. The barge may be used to support oil rigs and a variety of other support facilities. When work at a given site is complete, air is forced into the tubes again to force the water out so that welders can disconnect the joints between the tubes and the piles. Disconnecting the joints allows the barge to rise in the water, permitting the barge to be towed to a different location.

8 Claims, 5 Drawing Sheets

BARGE STABILIZATION METHOD

This application claims benefit of Prov. No. 60/086,618 filed May 22, 1998.

BACKGROUND OF THE INVENTION

1. Field of the Invention

The present invention relates to systems and methods for stabilizing barges used for drilling for undersea oil. More specifically, the invention is directed to stabilizing such barges despite a variety of harsh environmental conditions.

2. Related Art

In the field of continental shelf oil drilling, various techniques have been employed to attempt to stabilize oil drilling platforms. However, conventional stabilization systems have not efficiently dealt with extreme conditions, such as soft sea bottoms, earthquake survivability, high winds, ice flows, and substantial differences between high tide and low tide. The damage to or loss of a drilling platform is extremely costly in both monetary and human terms. With the ongoing depletion of fossil fuel reserves in readily-accessible and friendlier environments, there is a growing need to provide systems and methods for stabilizing and protecting oil drilling platforms, despite extreme environmental conditions.

The invention described hereinafter fulfills this need. Conventional arrangements are not believed to disclose the combination of features, or provide the advantages, that are provided by the invention. U.S. Pat. No. 3,859,806 and Re. 30,823 (Guy et al.) disclose pumping water out of tubes so that workers can weld parts of a leg together (see FIG. 13 and bottom half of column 6 of the text). FIGS. 100–102 and the text bridging columns 33 and 34 of U.S. Pat. No. 3,874,180 (Sumner) disclose how water is forced out of a chamber using forced air, to allow a worker to apply sealant between a piling 185 and a lower guide member 186. More generally, U.S. Pat. No. 4,257,720 (Ostgaard) and Ostgaard shows the general concept of welding sections of legs together. U.S. Pat. No. 4,575,282 (Pardue, Sr. et aL) discloses a system of driving a pile that involves forcing compressed air into a hollow pile that has already penetrated the marine floor, and then venting the air to allow resulting hydrostatic pressure to further drive the pile.

Despite these disparate teachings, no conventional arrangement is believed to provide a practical, comprehensive system and method of stabilizing an oil drilling platform in a variety of hostile environmental conditions.

SUMMARY OF THE INVENTION

The inventive oil drilling barge stabilization system and method provide that an array of piles is formed in the sea bed to a depth beneath the sea bed that finds solid support. A barge is towed into position over the array of piles, and the barge is partially flooded with ballast to lower it in the water so that a set of cylindrical tubes is positioned to surround top ends of at least some of the piles. Air is then forced into the tubes to force the water out the bottom of the tubes, to create a dry environment for workers. Workers weld the tubes to the piles. The air pressure is removed from the interior of the tubes so that water may again flood the bottom of the tubes.

The joints between the tubes and piles secure the barge to the array of piles, even in the face of varying tides, currents, and ice flow conditions. The barge may be used to support oil rigs and a variety of other support facilities.

When work at a given site is complete, air may be forced into the tubes again to force the water out so that welders can disconnect the joints between the tubes and the piles. Disconnecting the joints allows the barge to rise in the water, permitting the barge to be towed to a different location.

Other objects, features and advantages of the present invention will be apparent to those skilled in the art upon a reading of this specification including the accompanying drawings.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
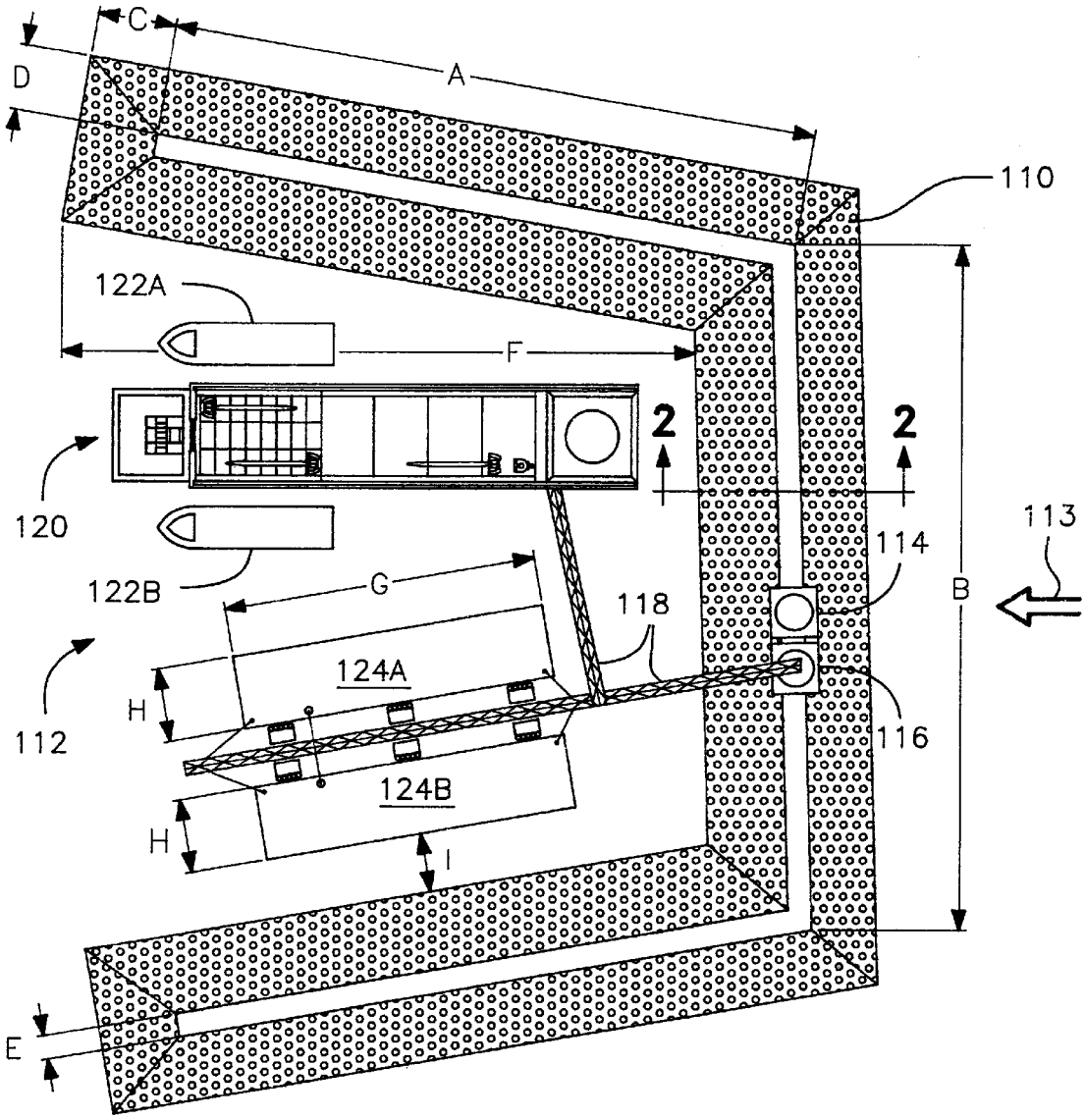
FIG. 1 is a plan view of an oil drilling site at which the present invention may be used.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

FIG. 1 is a plan view of an oil drilling site at which the present invention may be used. A generally U-shaped breakwater 110 that substantially surrounds a protected area 112 from current and ice flows moving in the direction of arrow 113. The breakwater may carry a heliport 114 and an abandonment platform 116, as well as a bridge network 118 leading to various structures in the protected area 112.

A drilling and production unit vessel 120, which will be the focus of the present invention, is illustrated at the end of one branch of the bridge network. In addition to a drilling and production unit, the drilling and production unit vessel 120 may contain a heliport, crew quarters, as well as production and power facilities that are illustrated in the side view of FIG. 3B. Two work boats 122A, 122B are illustrated alongside vessel 120. At another end of the bridge network are two crude oil transportation barges 124A, 124B.

Figure 2:
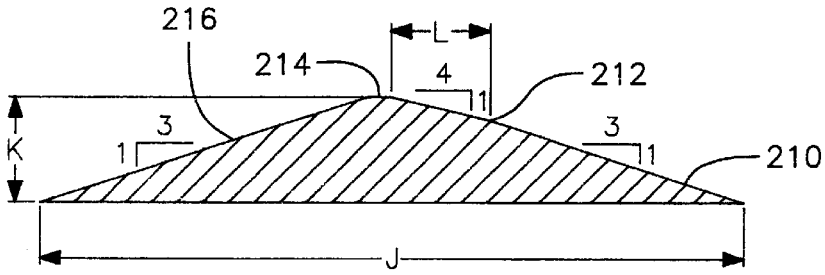
FIG. 2 is a side view, taken along section 2—2 in FIG. 1, showing features of a breakwater.

FIG. 2 illustrates is a side view, taken along section 2—2 in FIG. 1, showing features of the FIG. 1 breakwater 110. The breakwater is generally inverse-V in cross section, with a first surface 210 having a 1/3 rise-to-run ratio, a second surface 212 having a 1/4 rise-to-run ratio, a flat top surface 214 on which the heliport and abandonment platform are situated, and a fourth surface 216 having a 1/3 rise-to-run ratio. The breakwater is preferably made of boulders or the like, arranged in a U-shaped configuration that serves to break up and deflect sheets of ice that would otherwise endanger the structures in protected area 112 (FIG. 1).

Dimensions of the embodiment illustrated in FIGS. 1 and 2 are provided for the sake of illustration and not to limit the invention:

A: 514 feet

B: 563 feet

C: 63 feet

D: 53 feet

E: 20 feet

F: 500 feet

G: 250 feet

H: 60 feet

I: 49 feet

J: 136 feet

K: 21 feet

L: 20 feet

Figure 3A:
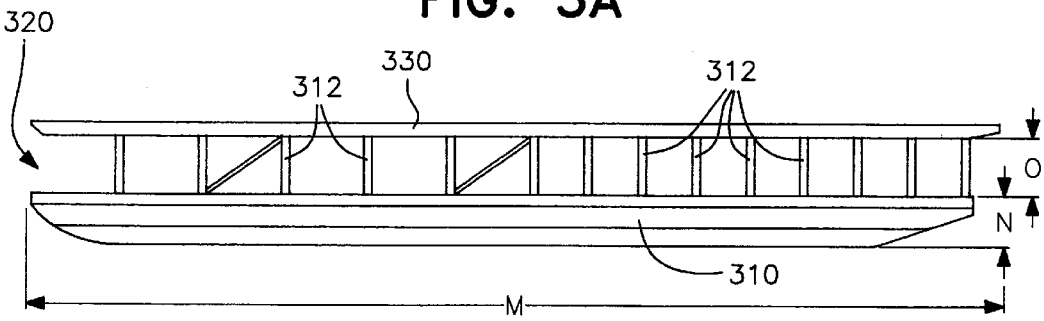
FIG. 3A is a side view of a lower barge that may be used in conjunction with the present invention.
Figure 3B:
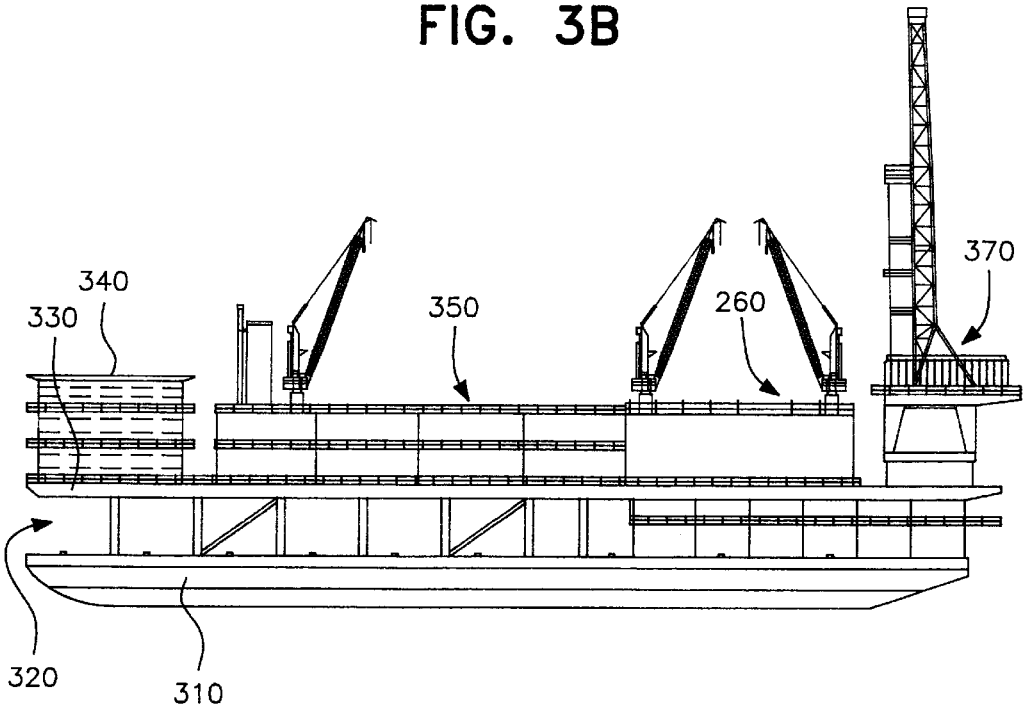
FIG. 3B is a side view of the lower barge, supporting an oil rig and various support facilities.

FIG. 3A is a side view of a lower barge that may be used in conjunction with the present invention. FIG. 3B is a side view of the lower barge, supporting an oil rig and various support facilities. The lower barge 310 is preferably a double-skin vessel capable of carrying a large capacity (for example, 72,800 barrels) of oil. The lower barge 310 has a network of pillars 312 (typical diameter: 42 inches) that form an air gap 320 and support an upper platform 330. The air gap 320 allows surface waves and ice flows to pass through the vessel rather than impacting it.

Atop the upper platform 330 may be a variety of units, such as the following non-limiting examples: a quarters package 340 with a topside heliport, a production/power package 350 (including waste heat recovery and fuel handling, electric generators, storage, supplies, metering, separator and heat treater, water treatment and chemical injection, separators), a self-contained drilling rig 360, and a substructure 370.

Dimensions of the embodiment illustrated in FIG. 3A are provided for the sake of illustration and not to limit the invention:

M: 396 feet

N: 22 feet

O: 23 feet

Figure 4A:
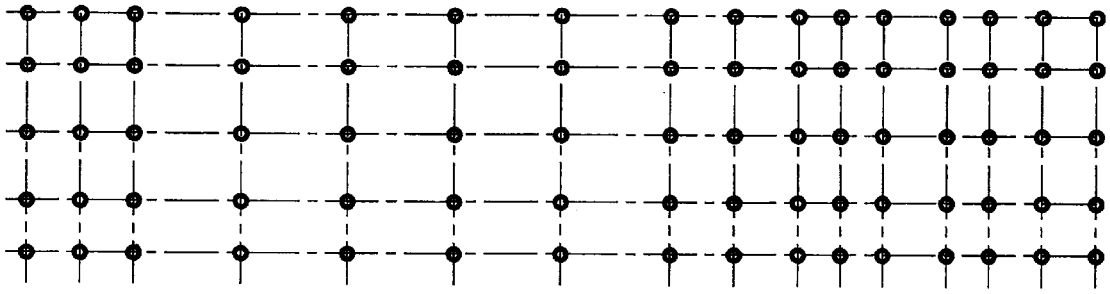
FIG. 4A illustrates an example of an array of piles formed in a sea bed to anchor barges according to the present invention.
Figure 4B:
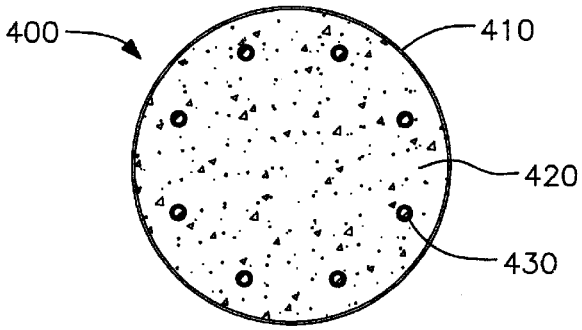
FIG. 4B shows a cross-sectional view of one such exemplary pile.

FIG. 4A illustrates an example of an array of piles formed in a sea bed to anchor barges according to the present invention, and FIG. 4B shows a cross-sectional view of one such exemplary pile.

As shown in FIG. 4A, the piles may be arranged in a five-row by sixteen-column array of eighty piles. In the illustrated example to which the invention should not be limited, the center-to-center distances between rows are 17.5 feet, 22.5 feet, 22.5 feet, and 17.5 feet. Within the rows, the center-to-center distances are (from left to right in the FIG. 4A example) 17.5 feet, 17.5 feet, 35 feet, 35 feet, 35 feet, 35 feet, 35 feet, 21 feet, 21 feet, 21 feet, 14 feet, 18.92 feet, and 16.08 feet.

FIG. 4B shows a pile 400 to have a circular cross-section fifty-four inches in diameter. A one-inch thick steel circular cylinder 410 contains concrete 420 in its interior. Preferably, longitudinally-extending steel reinforcement bars (rebars) 430 are embedded at regular circumferential angles in the concrete. In the illustrated example, eight rebars are situated at 45° intervals around the pile, about four-fifths of the distance from the axis of the pile to the pile's outer periphery. Of course, the dimensions and constitution of the pile may be varied while still remaining within the scope of the invention.

A set of tubes slightly larger in diameter than the piles is provided in the bottom portion of the lower barge. In a preferred embodiment, not all eighty piles are matched to tubes, but a suitable smaller number (for example, twenty) of the eighty piles are matched with tubes for attachment as described below. The particular piles that are designated for attachment to the barge's tubes may be chosen to be evenly distributed throughout the array of piles so as to stabilize the barge on the piles.

Figure 5:
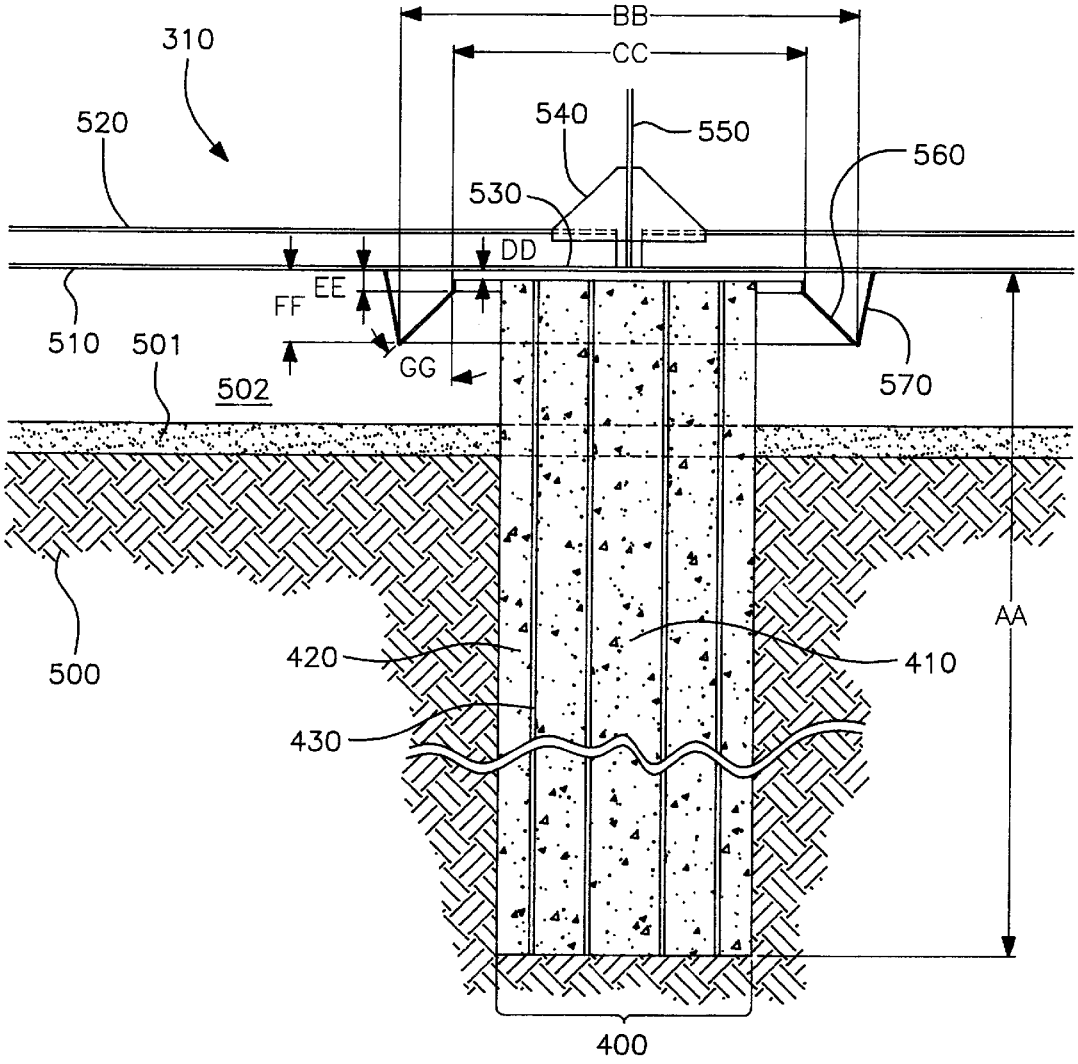
FIG. 5 is a side view showing a pile with guide plates, that may be used to attach to the barge when a tube is not used to extend downward from the barge.

FIG. 5 is a side view showing a pile 400 with guide plates, that may be used to attach a particular pile to the barge 310 when a tube is not used to extend downward from the barge. The pile 400 projects upward from the sea floor 500 through a fill layer 501 into water (or mud) 502 to contact a bottom plate 510 of the barge. The barge is provided with an interior sheet of angle framing material 520 that generally parallels the bottom plate 510. Isolation material 530 extending around the top of the pile cushions the area of contact between the pile and the barge's bottom plate.

A gusset plate 540, extending axially from the pile's interior, extends upwardly through the angle framing 520. The gusset plate 540 is attached through a bulkhead 550 in the interior of the barge. An annular guiding and stabilization portion formed by a guide plate 560 and a stiffener 570 are provided around the circumference of the point at which the pile contacts the bottom plate 510. When installed, collectively, the gusset plate 540, the guide plate 560, and the stiffener 570 stabilize the barge to the pile.

Figure 6:
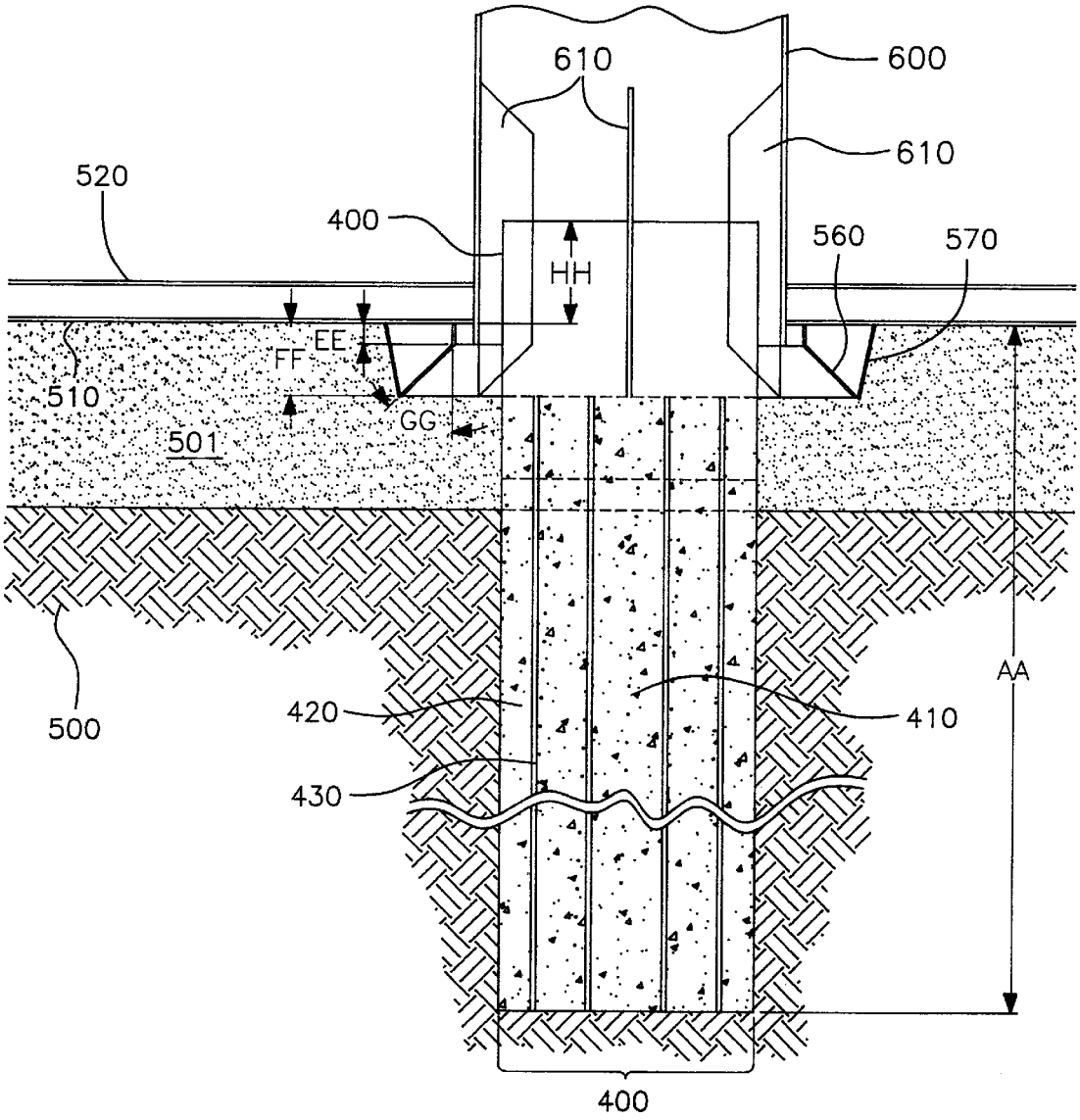
FIG. 6 shows a tube attached to a pile by attachment plates in accordance with the present invention.

The arrangement shown in FIG. 5 does not possess the advantages provided by an arrangement in which a tube extends downwardly from the barge to encompass and be attached to a pile. FIG. 6 shows a tube attached to a pile by plates in accordance with the present invention.

The pile 400, sea bed 500, fill 501, barge bottom plate 510, barge angle framing 520, guide plate 560 and stiffener 570, illustrated in FIG. 6, are substantially the same as shown and described above with reference to FIG. 5. However, the inventive embodiment of FIG. 6 additionally provides a tube 600 that extends downwardly from the barge to surround the top of the pile. Although not specifically illustrated in FIG. 6, it is preferred that the tubes are part of, or are arranged directly below, pillars 312 (FIG. 3A), so as to provide solid support for the structural units 340, 350, 360, 370 that are situated atop upper platform 330 (FIG. 3B). In a preferred embodiment, the diameter of the tube (example: sixty inches) is larger than the diameter of the pile (example: fifty-four inches).

Significantly, the inner surface of the tube is connected to the outer surface of the pile by a set of attachment plates 610. The attachment plates 610 are preferably shaped as ⅝-inch-thick trapezoids, with the longer (sixty inches) parallel end being attached to the tube and the shorter parallel end being attached to the pile. The attachment plates are welded to the tube and pile, being arranged at regular circumferential intervals. In a particular embodiment, there are eight attachment plates arranged at regular 45° intervals.

When the barge is being loaded with ballast water during site set-up, the angle GG (example: 45°) of the guide plate 560 serves to guide the pile into position in the tube. The angled sides of the trapezoidal attachment plates 610 also serve to center the pile in the tube.

Dimensions of the illustrated embodiment of FIGS. 5 and 6 are provided for the sake of illustration and not to limit the invention:

| | |
|---|---|
| AA: | 130 feet (varies, based on subsurface conditions) |
| BB: | 7.167 feet |
| CC: | 5.5 feet |
| DD: | 2.0 inches |
| EE: | 5.0 inches |
| FF: | 1.167 feet |
| GG: | 45° |
| HH (FIG. 6 only): | 1.667 feet |

The inventive structure of an embodiment of the barge stabilization system having been described above, an inventive method of stabilizing the barge is now described in greater detail.

The array of piles (for example, as shown in FIG. 4A) is formed in the sea bed to a depth beneath the sea bed that finds solid support. The barge is towed into position over the array of piles, and the barge is partially flooded with ballast water to lower the barge in the water so that a set of cylindrical tubes is positioned to surround top ends of at least some of the piles. The angled guide plates 560 and the angled (non-parallel) sides of the trapezoidal attachment plates 610 serve to guide and center the pile in the tube.

In a particular embodiment, the top of the pile is provided with a shock-absorbing material to avoid damage when it contacts the barge. The shock absorbing material may be similar to isolation material 530 (FIG. 5).

Air is then forced into the tubes to force the water out the bottom of the tubes, to create a dry environment for workers. Workers enter the dry environment in the interior of the tubes, and weld the tubes to the piles by the attachment plates 610. Afterwards, the air pressure is removed from the interior of the tubes so that water may again flood the bottom of the tubes. The ballast water in the partially-flooded barge is pumped out to make way for the crude oil that is pumped from beneath the sea bed.

The joints between the tubes and piles secure the barge to the array of piles, even in the face of varying tides, currents, and ice flow and earthquake conditions. The ballast water is no longer needed to maintain the barge's position. The barge may be used to support oil rigs and a variety of other support facilities, not merely those shown in FIG. 3B.

When work at a given site is complete, air may be forced into the tubes again to force the water out so that welders can disconnect the attachment plates between the tubes and the piles. Disconnecting the attachment plates allows the barge to rise in the water, permitting the barge to be towed to a different location.

Modifications and variations of the above-described embodiments of the present invention are possible, as appreciated by those skilled in the art in light of the above teachings. For example, the configuration of the array of piles, the choice of which piles are matched with tubes for attachment, and the physical dimensions of the elements described above may be varied while not departing from the scope of the invention. It is therefore to be understood that, within the scope of the appended claims and their equivalents, the invention may be practiced otherwise than as specifically described.

What is claimed is:

1. A method of stabilizing a barge above a sea bed, the barge having plural hollow tubes extending downwardly therefrom, the method comprising:

placing an array of piles extending upward from the sea bed;

moving the barge into position over the array of piles;

at least partially flooding the barge to lower it in the water so that the tubes are positioned to surround top ends of respective piles;

forcing air into the tubes to force water out the bottom of the tubes and create an air environment inside the tubes;

attaching the tubes to the piles in the air environment; and removing forced air pressure from the interior of the tubes so that water may again flood the bottom of the tubes.

2. The method of claim 1, further comprising:

forcing air into the tubes to force the water out of the tubes; and disconnecting joints between the tubes and the piles to allow the barge to rise in the water, unconnected to the piles.

3. The method of claim 1, further comprising:

providing a generally U-shaped breakwater upstream from the barge to protect the barge from ice flows.

4. The method of claim 1, wherein the placing of the array of piles includes:

placing piles that include a steel tube having an interior containing steel reinforced concrete.

5. The method of claim 1, wherein:

less than all the piles are connected to tubes.

6. The method of claim 1, wherein the attaching step includes:

welding plural attachment plates to connect and extend radially between an outer surface of the pile and an inner surface of the tube.

7. The method of claim 1, wherein the attaching includes:

welding eight trapezoidal attachment plates to connect and extend radially between an outer surface of the pile and an inner surface of the tube, at regular circumferential intervals of about forty-five degrees.

8. The method of claim 1, wherein:

the tubes have diameters that are greater than diameters of respective piles.

* * * * *